US005586462A

United States Patent [19]

Takeuchi et al.

[11] Patent Number: 5,586,462

[45] Date of Patent: Dec. 24, 1996

[54] DEVICE AND METHOD FOR FORMING BENT PIPE OF NON-ANNULAR CROSS-SECTION

[75] Inventors: Kiyoshi Takeuchi, Toyota; Shin Takeda, Nagoya; Masao Nakamura, 2-1, Aza Higashiura, Kitayama-cho, Toyohashi city, Aichi-pref., all of Japan

[73] Assignees: Aisin Seiki Kabushiki Kaisha; Masao Nakamura, both of Aichi, Japan

[21] Appl. No.: 380,947

[22] Filed: Jan. 31, 1995

[30] Foreign Application Priority Data

Jan. 31, 1994 [JP] Japan ..... 6-009186

[51] Int. Cl.[6] ..... B21D 9/05; B21C 1/24; B21B 17/02

[52] U.S. Cl. ..... 72/150; 72/283; 72/370

[58] Field of Search ..... 72/150, 166, 168, 72/283, 369, 320, 391.2

[56] References Cited

U.S. PATENT DOCUMENTS

| | | | |
|---|---|---|---|
| 1,478,480 | 12/1923 | Lowe | 72/150 |
| 2,102,099 | 12/1937 | Singer | 72/283 |
| 2,234,863 | 3/1941 | Heetkamp | 72/283 |
| 4,008,596 | 2/1977 | Petrov et al. | 72/370 |
| 4,397,173 | 8/1983 | Eftefield et al. | 72/370 |
| 4,481,803 | 11/1984 | Dieser | 72/150 |

FOREIGN PATENT DOCUMENTS

| | | |
|---|---|---|
| 51-7151 | 3/1976 | Japan . |
| 62-134120 | 6/1987 | Japan . |
| 2-30336 | 1/1990 | Japan . |
| 2-268927 | 11/1990 | Japan . |

*Primary Examiner*—Lowell A. Larson
*Assistant Examiner*—Rodney Butler
*Attorney, Agent, or Firm*—Hazel & Thomas, P.C.

[57] ABSTRACT

A device for converting a straight pipe having an annular cross-section defined between an inner diameter and an outer diameter into a bent pipe having a non-annular cross-section, and method for making the same are disclosed. The device includes a round, bar-shaped guide member having a first end portion and a second end portion which is spaced therefrom in the axial direction and for being mounted slidably with the straight pipe. A floating member is formed into a prismoid and connected to the second end of the round, bar-shaped guide member in a ball-and-socket joint. The prismoid includes a first end in the form of a small polygon whose maximum radial length is less than the inner diameter of the straight pipe, and a second end in the form of a large polygon similar to the small polygon in shape and spaced from the first end in the axial direction. The prismoid has trapezoid sides disposed between the first end and the second end in such a manner that a corner angle between two adjacent trapezoid sides decreases gradually away from the first end. A feeding device slides the straight pipe on the round, bar-shaped guide member toward the floating member so that the straight pipe is brought into engagement with the floating member, thereby establishing the non-annular cross-section of the straight pipe. Lastly, a bending device bends the resulting pipe by applying a force thereto.

10 Claims, 8 Drawing Sheets

DEVICE AND METHOD FOR FORMING BENT PIPE OF NON-ANNULAR CROSS-SECTION

BACKGROUND OF THE INVENTION

1. Field of the Invention

The present invention relates to a device and a method for forming a bent pipe of a non-annular cross-section used, for example, as intake manifolds.

2. Description of the Prior Art

In Japanese Patent Laid Open Print Number Hei.2(1990)-268927, which was published on Nov. 2, 1990, without examination, there is disclosed a pipe bending device by which a straight pipe is bent into a bent pipe with a curvature. This device includes a round bar shaped guide member, and a floating member connected to a distal end of the round bar shaped guide member in a ball-and-socket joint manner. The floating member has a circular portion whose radius is larger than that of the straight pipe. While the straight pipe slides on the round bar-shaped guide member toward its distal end, the straight pipe, under movement, is being fitted with the floating member, thereby expanding the radius of the straight pipe. The resultant pipe is applied with a force from a bending device and, thus, the straight pipe with the expanded radius is Formed into the bent pipe having the curvature.

In Japanese Patent Publication Number Sho. 51(1976)-7151, published on Mar. 5, 1976, after examination, there is disclosed a device including a round, bar-shaped guide member and an expanding member connected fixedly to a distal end of the round, bar-shaped guide member. The member has a circular portion whose radius is larger than that of a straight pipe having an annular cross-section. While the straight pipe slides on the round, bar-shaped guide member toward its distal end, the straight pipe, under movement, is being fitted with the expanding member, thereby expanding the radius of the pipe. This pipe is also bent into a curvature. This reference suggests literally that changing a cross-section of such an expanding member will enable the obtaining of a bent pipe having a non-annular cross-section from a straight pipe having an annular cross-section.

By reforming the cross-section of the floating member in the former disclosure into a prismoid structure at the suggestion of the latter disclosure, a device was found for obtaining a bent pipe which is of a non-annular cross-section from a straight pipe. However, bent pipes obtained by that device were unsatisfactory for the reason that cracks, destroyed portions, rumples and/or spring backs were found in the bent pipe.

SUMMARY OF THE INVENTION

It is, therefore, an object of the present invention to provide a device and a method for obtaining a bent pipe of a non-annular cross-section without the foregoing drawbacks.

It is another object of the present invention to provide a device and a method for obtaining a bent pipe of a non-annular cross-section in such a manner that an annular cross-section of a straight pipe is gradually formed into a non-annular cross-section.

In order to attain the foregoing objects, the present invention is directed to a device for converting a straight pipe having an annular cross-section defined between an inner diameter and an outer diameter into a bent pipe having a non-annular cross-section. The device includes a round, bar-shaped guide number having a first end portion and a second end potion which is spaced therefrom in the axial direction for being mounted slidably with the straight pipe. A floating member is formed into a prismoid and connected to the second end of the round, bar-shaped guide member in a ball-and-socket manner. The prismoid includes a first end in the form of a small polygon whose maximum radial length is less than the inner diameter of the straight pipe, and a second end in the form of a large polygon similar to the small polygon in shape and spaced from the first end in the axial direction and having trapezoid sides disposed between the first end and the second end in such a manner that a corner angle or arcuate corner between two adjacent trapezoid sides decreases gradually away from the first end. A feeding device slides the straight pipe on the round, bar-shaped guide member toward the floating member so that the straight pipe is brought into engagement with the floating member, thereby establishing the non-annular cross-section of the straight pipe. Lastly, a bending device is used for bending the resultant pipe by applying a force thereto.

BRIEF DESCRIPTION OF THE DRAWINGS

The invention will be further described in conjunction with the accompanying drawings which.

DETAILED DESCRIPTION OF THE INVENTION

Figure 1:
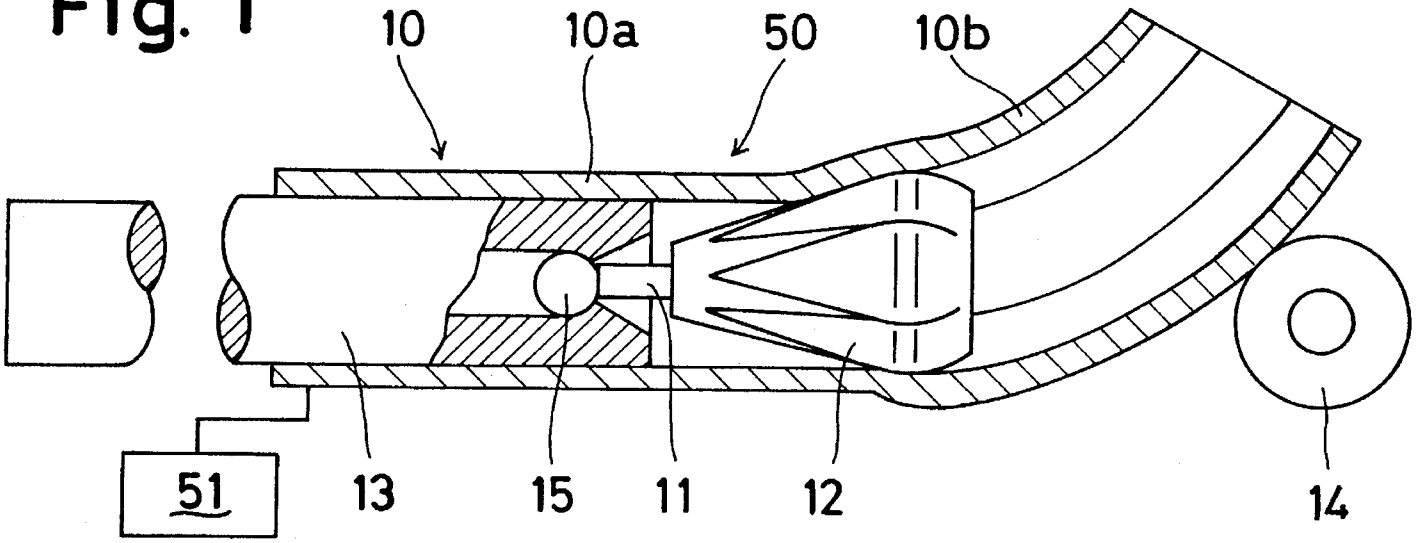
FIG. 1 is an illustrative view of a device in accordance with the present invention.
Figure 2:
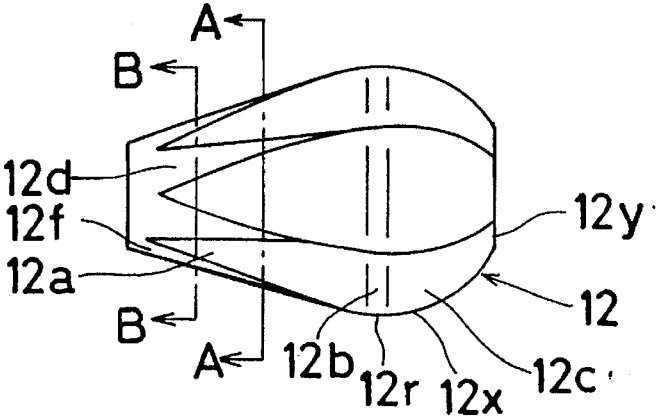
FIG. 2 is a front view of a first type of floating member in the device shown in FIG. 1.
Figure 3:
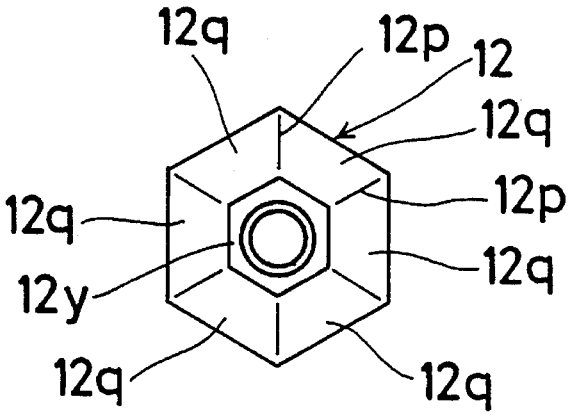
FIG. 3 is a right-side view of the first type of floating member shown in FIG. 2.
Figure 4:
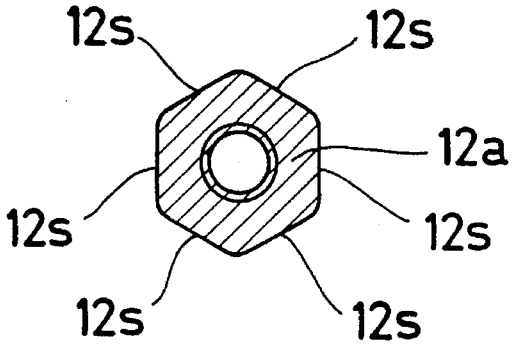
FIG. 4 is a cross-sectional view taken along line A—A in FIG. 2.
Figure 5:
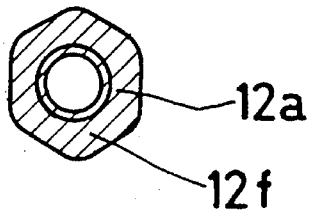
FIG. 5 is a cross-sectional view taken along line B—B in FIG. 2.
Figure 6:
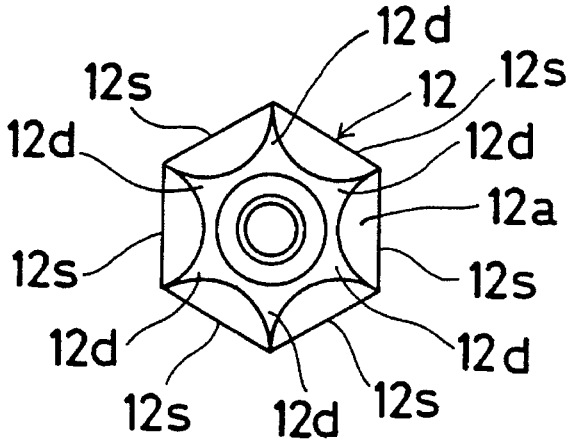
FIG. 6 is a left-side view of the first type of floating member shown in FIG. 2.
Figure 7:
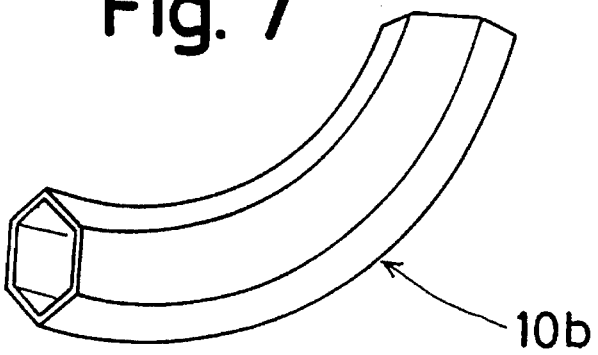
FIG. 7 is a perspective partial view of a bent pipe formed by the device shown in FIG. 1.

With reference to the figures, wherein like reference characters indicate like elements throughout the several views and, in particular, with reference to FIGS. 1 to 7, inclusive, a stainless steel pipe 10 is expected to be formed from its original condition 10*a* (hereinafter sometimes referred to as a straight pipe 10*a*) which is of an annular cross-section to a bent condition 10*b* (hereinafter sometimes referred to as a bent pipe 10*b*) which is of a non-annular cross-section using a device 50. The straight pipe 10*a* has an annular cross-section defined by an inner diameter and an outer diameter. The device 50 includes a core or guide member 13 which is in the form of a round, bar-shaped structure. The guide member 13 has a first end (left end as shown in FIG. 1) and a second end (right end, as also shown in FIG. 1) which is spaced from the first end (left end) in the axial direction. The guide member 13 has a diameter which is slightly less than the inner diameter of the straight pipe 10*a* so that the straight pipe is able to slide on the guide member 13 from its first end (left end) to the second end (right end). For moving the straight pipe 10*a*, a feeding device 51, which may be in the form of a pair of rollers, is used.

At the second end (right end) of the guide member 13, there is connected a first end (left end, as viewed in FIG. 1) of a rod 11 in a ball-and-socket joint 15. A second end (right end, as shown in FIG. 1) of the rod 11 is fixedly connected to a first end (left end, as shown in FIG. 1) of the floating member 12. Thus, the floating member 12 is, as a whole, connected to the second end (right end) of the guide member 13 through the rod 11 in a ball-and-socket joint 15.

The floating member 12 includes an expanding portion 12*a* which is in the form of a hexagonal prismoid, an intermediate portion 12*b* and a reducing portion 12*c*. The expanding portion 12*a* has a first end (left end, as viewed in FIG. 1) 12*f* which is in the form of a small size hexagon. The maximum radial length of the first end (left end) 12*f* of the expanding portion 12*a* is less than the inner diameter of the straight pipe 10*a*. The expanding portion 12*a* has a second end (right end, as shown in FIG. 1) 12*r* which is in the form of a large size hexagon. The first end (left end) 12*f* is spaced from the second end (right end) 12*r* in the axial direction. Six trapezoid sides 12*s* are disposed between the first end (left end) 12*f* and the second end (right end) 12*r*. A corner angle 12*d* between two adjacent trapezoid sides 12*s* decreases gradually away from the first end (left end) 12*f*.

The intermediate portion 12*b* of the floating member 12 is connected to the second end (right end) 12*r* of the expanding portion 12*a* and is set to be slightly larger than and identical with the second end (right end) 12*r* of the expanding portion 12*a* in size and shape, respectively. The intermediate portion 12*b* of the floating member 12 is in the form of a hexahedron which is thin in the axial direction.

The reducing portion 12*c* includes a first end (left end, as viewed in FIG. 1) 12*x* in the form of a large size hexagon which is identical to the intermediate portion 12*b* in size and shape, a second end (right end, as shown in FIG. 1) 12*y* which is in the form of a small hexagon, and eight trapezoid sides 12*q* disposed between the first end (left end, as shown in FIG. 1) 12*x* and the second end (right end, as shown in FIG. 1) 12*y*. An arcuate corner or corner angle 12*p* between two adjacent trapezoid sides 12*q* decreases gradually toward the first end (left end) 12*f*.

While the straight pipe 10 allows sliding movement of the guide member 13, the straight pipe 10*a* is brought into engagement with the expanding portion 12*a* of the floating member 12, thereby gradually converting the cross-section of the pipe 10*a* into the non-annular cross-section. Such a gradual change of the cross-section of the pipe 10*a*, which is established by the foregoing shaped corner angles 12*d* between the adjacent trapezoid side 12*s*, prevents the formation of cracks, destroyed portions, rumples and/or spring backs on the pipe 10.

After passing the intermediate portion 12*b* and the reducing portion 12*c* of the floating member 12, the pipe 10*a* having the non-annular cross-section is applied with a force from a bending device 14, thereby obtaining the bent pipe 10*b*. Thus, the bent pipe 10*b* results in the configuration shown in FIG. 7. The foregoing shaped corner angles 12*p* of the reducing portion 12 prevents the formation of cracks, destroyed portions, rumples and/or spring backs in the pipe 10*a* while the pipe 10*a* is being bent. However, the intermediate portion 12*b* and/or the reducing portion 12*c* of the floating member are not essential for the prevention of the cracks, destroyed portions, rumples and/or spring backs in the pipe 10*a*.

Figure 8:
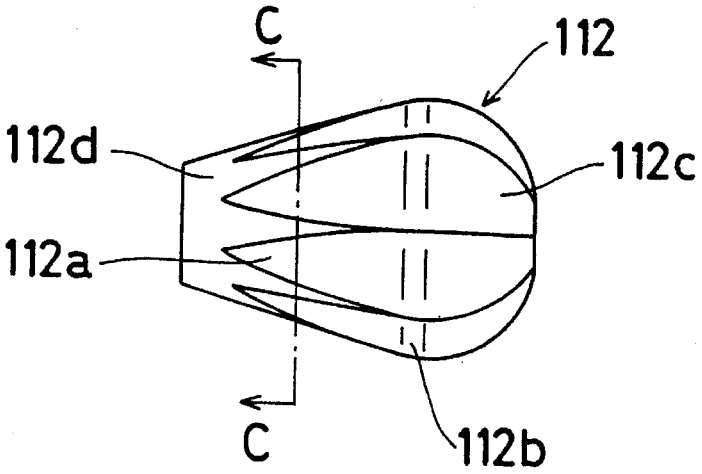
FIG. 8 is a front view of a second type of floating member.
Figure 9:
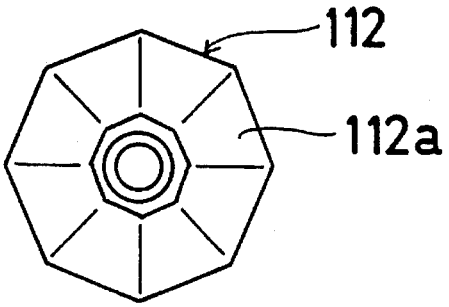
FIG. 9 is a right-side view of the second type of floating member shown in FIG. 8.
Figure 10:
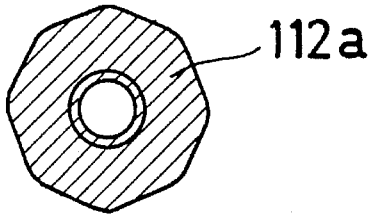
FIG. 10 is a cross-sectional view taken along line C—C in FIG. 8.
Figure 11:
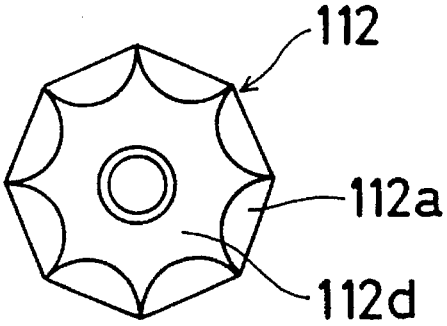
FIG. 11 is a left-side view of the second type of floating member shown in FIG. 8.
Figure 12:
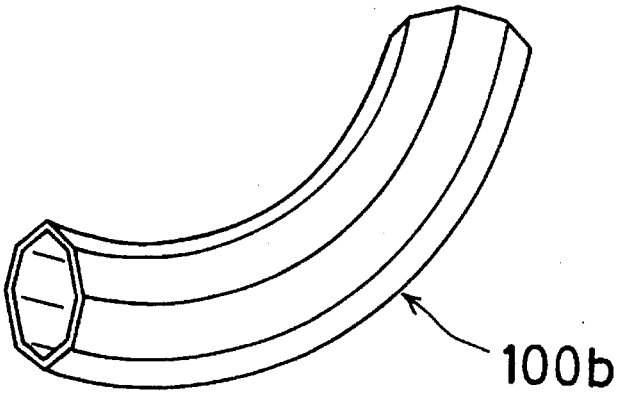
FIG. 12 is a perspective partial view of a bent pipe formed by using the second type of floating member.
Figure 13:
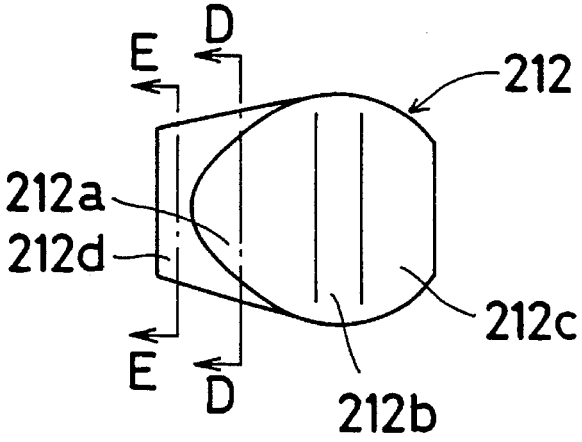
FIG. 13 is a front view of a third type of floating member.
Figure 14:
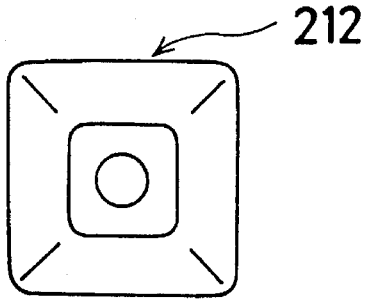
FIG. 14 is a right-side view of the third type of floating member shown in FIG. 13.
Figure 15:
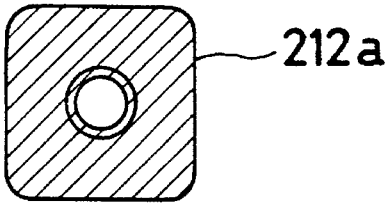
FIG. 15 is a cross-sectional view taken along line D—D in FIG. 12.
Figure 16:
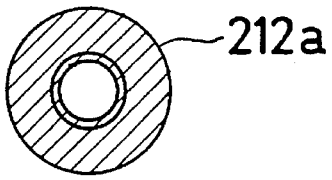
FIG. 16 is a cross-sectional view taken along line E—E in FIG. 12.
Figure 17:
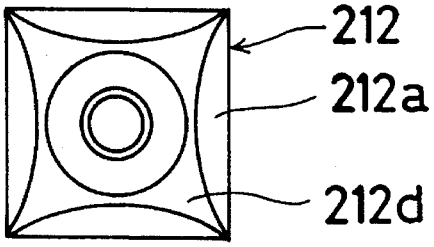
FIG. 17 is a left-side view of the third type of floating member shown in FIG. 12.
Figure 18:
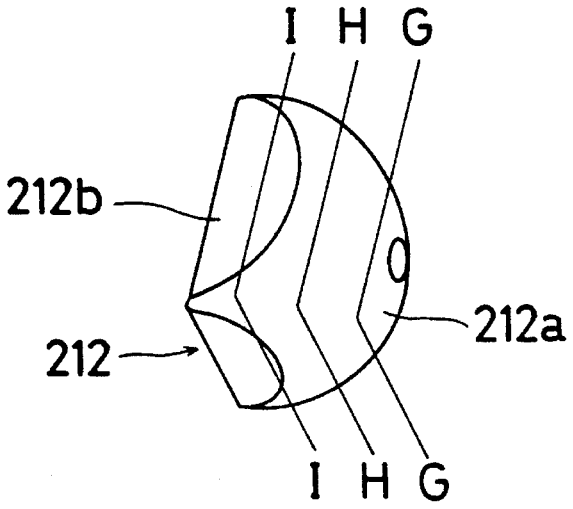
FIG. 18 is a perspective view of a fourth type of floating member.
Figure 19:
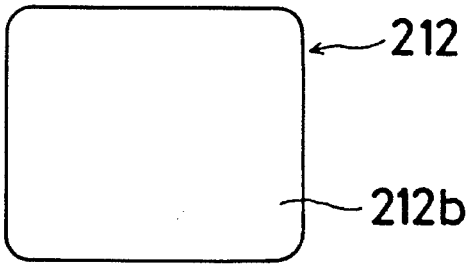
FIG. 19 is a left-side view of the fourth type of floating member shown in FIG. 18.
Figure 20:
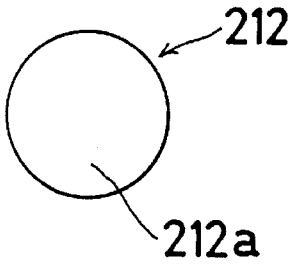
FIG. 20 is a cross-sectional view taken along line G—G in FIG. 18.
Figure 21:
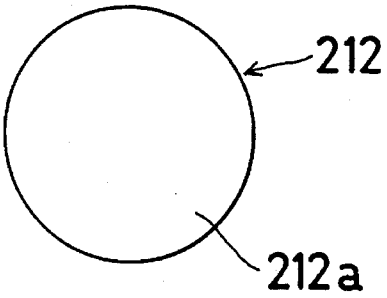
FIG. 21 is a cross-sectional view taken along line H—H in FIG. 18.
Figure 22:
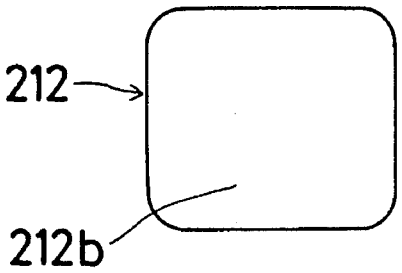
FIG. 22 is a cross-sectional view taken along line I—I in FIG. 18.
Figure 23:
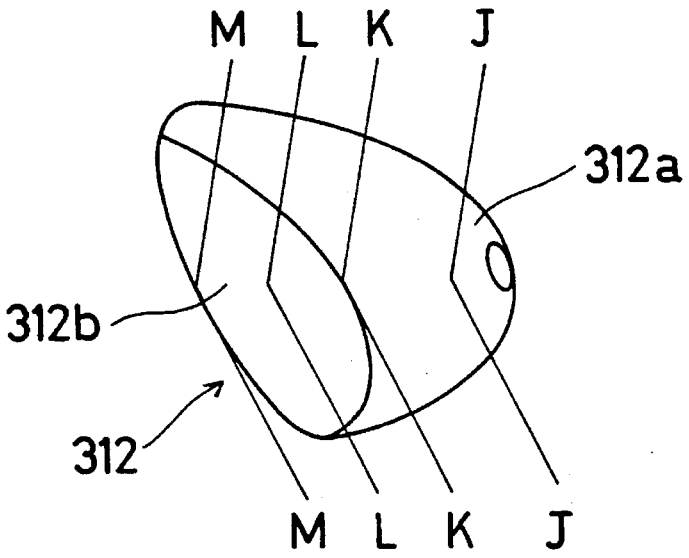
FIG. 23 is a perspective view of a fifth type of floating member.
Figure 24:
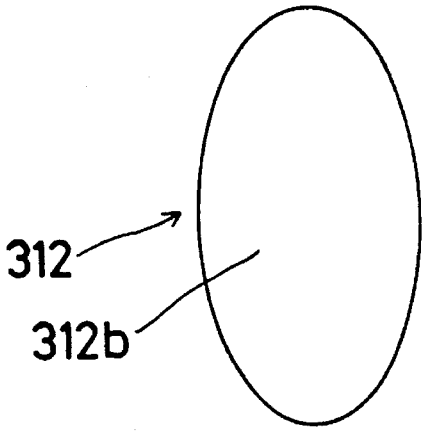
FIG. 24 is a left-side view of the fifth type of floating member shown in FIG. 23.
Figure 25:
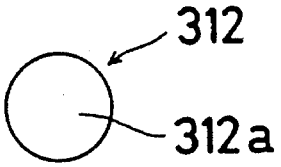
FIG. 25 is a cross-sectional view taken along line J—J in FIG. 23.
Figure 26:
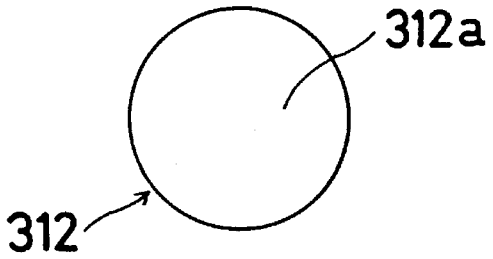
FIG. 26 is a cross-sectional view taken along line K—K in FIG. 23.
Figure 27:
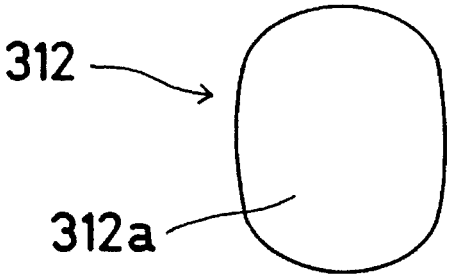
FIG. 27 is a cross-sectional view taken along line L—L in FIG. 23.
Figure 28:
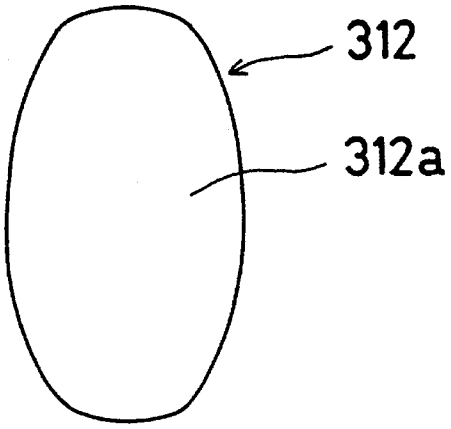
FIG. 28 is a cross-sectional view taken along line M—M in FIG. 23.

In FIGS. 8 through 11, there is shown a floating member 112 having an expanding portion 112*a*, an intermediate portion 112*b*, a reducing portion 112*c* and corner angles 112*d* which correspond to the expanding portion 12*a*, the intermediate portion 12*b*, the reducing portion 12*c* and corner angles 12*d* of the floating member 12, respectively. The floating member 112 is formed based on a concept similar to the floating member 12 except that a first end (left end, as shown in FIG. 8) and a second end (right end, as shown in FIG. 8) of the floating member 112 are in the form of a small octagon and a large octagon, respectively. Thus, using the floating member 112, instead of the floating member 12, a bent octagonal pipe 100*b*, as shown in FIG. 12, is obtained.

In FIGS. 13 through 17, there is shown a floating member 212 having an expanding portion 212*a*, an intermediate portion 212*b*, a reducing portion 212*c* and corner angles 112*d*, which correspond to the expanding portion 12*a*, the intermediate portion 12*b*, the reducing portion 12*c* and corner angles 12*d* of the floating member 12, respectively. The floating member 212 is formed based on a concept similar to the floating member 12 except that a first end (left end, as figured in FIG. 13) and a second end (right end as viewed in FIG. 13) of the floating member 212 are in the form of a small square and a large square, respectively. Thus, using the floating member 212 instead of the floating member 12, a bent square pipe 100*b*, as shown in FIG. 12, is obtained.

In FIGS. 18 through 22, there is shown a floating member 212, which has an expanding portion 212*a* and a termination portion 212*b* having a rectangular cross-section. As apparent from such illustrations, the expanding portion 212*a* leads from a straight pipe of an annular cross-section to a terminating portion 212*b* of a rectangular cross-section. During this transfer, due to the gradual change of the cross-section of the expanding portion 212*a* toward the terminating portion 212*b*, the annular cross-section of the straight pipe is changed to a rectangular cross-section.

In FIGS. 23 through 28, there is shown a floating member 312 which has an expanding portion 312*a* and a termination portion 312*b* having an elliptical cross-section. As apparent from such illustrations, the expanding portion 312*a* leads from a straight pipe of an annular cross-section to a terminating portion 312*b* of an elliptical cross-section. During this transfer, due to the gradual change of the cross-section of the expanding portion 312*a* toward the terminating portion 312*b*, the annular cross-section of the straight pipe is changed to the elliptic cross-section.

Other than being used for forming intake manifolds, the bent pipe of the present invention of non-annular cross-section can be used for various purposes, such as for forming railings of balconies.

It will be appreciated by those of ordinary skill in the art that the present invention can be embodied in other specific forms without departing from the spirit or essential characteristics thereof. The presently disclosed embodiments are therefore considered in all respects to be illustrative and not restrictive. The scope of the invention is indicated by the appended claims rather than the foregoing description and changes that come within the meaning and range of equivalents thereof are intended to be embraced therein.

What is claimed is:

1. A device for converting a straight pipe having an annular cross-section defined between an inner diameter and an outer diameter into a bent pipe having a non-annular cross-section, comprising:

a round, bar-shaped guide member having a first end portion and a second end portion spaced from the first end portion in the axial direction, said guide member being adapted for mounting slidably with the straight pipe;

a floating member including an expanding portion with a first end thereof being connected to the second end of said guide member in a ball-and-socket joint, said first end having a cross-section in the form of a circle with a diameter less than the inner diameter of said straight pipe, said expanding portion further having a second end with a cross-section formed as a polygon and a maximum diameter larger than the inner diameter of the straight pipe, wherein a cross-sectional area of said expanding portion along a longitudinal axis of said floating member increases from said first end to said second end having said maximum diameter, an outer surface area of said expanding portion comprising a plurality of adjacent trapezoids positioned to form sides of said polygon in cross-section with adjacent pairs of said polygon sides each defined to form an arcuate corner therebetween with a predetermined radius, the predetermined radius of adjacent polygon sides being defined to progressively decrease from said first end to said second end of said expanding portion;

feeding means for sliding said straight pipe on said guide member toward said floating member such that said straight pipe is brought into engagement with said floating member thereby forming said non-annular cross-section of said straight pipe; and bending means for bending the resultant pipe by applying a force thereto.

2. The device as set forth in claim 1 further comprising an intermediate portion at said second end of said floating member, said intermediate portion being formed with a cross-section similar to said second end of said floating member in shape and identical thereto in size.

3. The device as set forth in claim 2 further comprising a reducing portion, said reducing portion including a first end connected to and congruent in cross-sectional shape with said intermediate portion, and a second end smaller in size than and similar in shape to said first end, wherein a cross-sectional area of said reducing portion decreases along the longitudinal axis of said floating member from said first end to said second end of said reducing portion.

4. A device for forming a bent pipe having a non-annular cross-section from a straight pipe with an annular cross-section, comprising:

a floating member for expanding the cross-section of said straight pipe while said straight pipe is being moved on said floating member;

a round, bar-shaped guide member for guiding said straight pipe toward said floating member whereby a pre-expanded portion of said straight pipe is expanded in its radial direction, said guide member having a diameter slightly less than an inner diameter of said straight pipe; and bending means for bending said straight pipe immediately after expansion of the cross-section into a curvature, wherein the floating member includes an expanding portion having a first end with a diameter smaller than an inner diameter of the straight pipe and a second end with a diameter larger than the inner diameter of the straight pipe and with a cross-sectional area being non-circular, the cross-sectional area of said expanding portion increasing from said first end along a longitudinal axis of said floating member, and an outer surface of said expanding portion being defined with at least one trapezoid-shaped face, and an intermediate portion having a cross-sectional area identical to said second end of said expanding portion.

5. A method for converting a straight pipe having an annular cross-section defined between an inner diameter and an outer diameter into a bent pipe having a non-annular cross-section, said method comprising the steps of:

providing a round, bar-shaped guide member having a first end portion and a second end portion spaced from each other along a longitudinal axis of the guide member;

forming a floating member with an expanding portion that has a circular first end with a diameter less than the inner diameter of the straight pipe and a polygon-shaped second end with a diameter larger than the inner diameter of the straight pipe, the first and second ends being spaced apart from each other along a longitudinal axis of the floating member, wherein said step of forming the floating member includes forming an outer surface area of said expanding portion as a plurality of adjacent trapezoids positioned to form sides of polygon-shaped cross-sections of said expanding portion and of said second end with adjacent pairs of said polygon sides each defined to form an arcuate corner therebetween having a predetermined radius, the predetermined radius of adjacent polygon sides being defined to progressively decrease from said first end to said second end of said expanding portion;

connecting said first end of said floating member with said guide member in a ball-and-socket joint;

mounting said straight pipe on said round, bar-shaped guide member;

moving said straight pipe continuously along said round, bar-shaped guide member toward said floating member to thereby gradually change the annular cross-section of said straight pipe into a non-annular cross-section; and applying a force to the resultant straight pipe for bending the resultant straight pipe with a curvature.

6. A method for forming a bent pipe having a non-annular cross-section from a straight pipe with an annular cross-section, said method comprising the steps of:

forming a floating member that has an expanding portion and an intermediate portion, wherein said expanding portion is formed with a first end having a diameter smaller than an inner diameter of the straight pipe and a second end with a diameter larger than the inner diameter of the straight pipe and with a cross-sectional area formed to be non-circular, and an outer surface of said expanding portion being defined with at least one trapezoid-shaped face, and said intermediate portion is formed with a cross-sectional area identical to said second end of said expanding portion;

guiding said straight pipe on said floating member;

expanding the cross-section of said straight pipe on said expanding portion of said floating member:

finishing the inner surface of said straight pipe smoothly by moving said straight pipe on said intermediate portion of said floating member; and bending said straight pipe into a curvature.

7. The device as set forth in claim 1, wherein said floating member is swingably connected via the ball-and socket joint.

8. The device as set forth in claim 1, wherein said arcuate corners of adjacent polygon sides are formed to continuously connect between said adjacent polygon sides.

9. A device for converting a straight pipe having an annular cross-section defined between an inner diameter and an outer diameter into a bent pipe having a non-annular cross-section, comprising:

a round, bar-shaped guide member having a first end portion and a second end portion spaced from the first end portion in an axial direction, said guide member being adapted for mounting slidably within the straight pipe:

a floating member including an expanding portion with a first end thereof being connected to the second end of said guide member in a ball-and-socket joint, said first end having a cross-section in the form of a circle with a diameter less than the inner diameter of said straight pipe, said expanding portion further having a second end with a cross-section formed as a polygon and a maximum diameter larger than the inner diameter of the straight pipe, wherein a cross-sectional area of said expanding portion along a longitudinal axis of said floating member increases from said first end to said second end having said maximum diameter, an outer surface area of said expanding portion comprising a plurality of adjacent trapezoids positioned to form sides of said polygon in cross-section with adjacent pairs of said polygon sides each defined to form an arcuate corner therebetween with a predetermined radius, the predetermined radius of the arcuate corner of adjacent polygon sides being defined to be constant from said first end to said second end of said expanding portion, and said arcuate corners of adjacent polygon sides are formed to discontinuously connect between said adjacent polygon sides;

feeding means for sliding said straight pipe on said guide member toward said floating member such that said straight pipe is brought into engagement with said floating member thereby forming said non-annular cross-section of said straight pipe; and bending means for bending the resultant pipe by applying a force thereto.

10. The device as set forth in claim 9 further comprising an intermediate portion at said second end of said floating member, said intermediate portion being formed with a cross-section similar to said second end of said floating member in shape and identical thereto in size.

* * * * *